United States Patent [19]

Saunders

[11] Patent Number: 4,809,669

[45] Date of Patent: Mar. 7, 1989

[54] COMBINATION ARROW REST AND ARROW SHAFT GUIDE

[76] Inventor: Charles A. Saunders, P.O. Box 746, Industrial Site, Columbus, Nebr. 68601

[21] Appl. No.: 194,393

[22] Filed: May 16, 1988

[51] Int. Cl.[4] ..... F41B 5/00

[52] U.S. Cl. ..... 124/24 R; 124/41 A

[58] Field of Search ..... 124/24 R, 24 A, 41 A, 124/88

[56] References Cited

U.S. PATENT DOCUMENTS

| | | | |
|---|---|---|---|
| 3,769,956 | 11/1973 | Simo | 124/24 R |
| 3,828,757 | 8/1974 | Finlay | 124/41 A |
| 4,133,334 | 1/1979 | Tone | 124/24 R |
| 4,380,226 | 4/1983 | Saunders | 124/41 A |
| 4,473,058 | 9/1984 | Terry | 124/24 R |

*Primary Examiner*—Randolph A. Reese
*Assistant Examiner*—Anthony Knight
*Attorney, Agent, or Firm*—Michael G. Berkman

[57] ABSTRACT

For use with an archery bow, a combination arrow rest and side support assembly for an arrow shaft. The assembly is formed of a pre-shaped, high-tensile-strength, flexible and resilient unitary spring wire fastened at a mid-zone thereof to a threaded mounting bolt which is secured in turn to a sidewall of the bow. The arrow rest portion of the wire is bent reversely upon itself to form an upwardly open loop, and then outwardly at an upwardly directed angle to terminate in a flexible and resilient, outstretched rest arm coated with a lubric, low-friction material. The loop serves as a passageway for unobstructed travel of a vane of the arrow therethrough during flight of the arrow from the bow, the arrow shaft resting on the resilient, upwardly angled arm of the arrow rest. The cooperating side support section of the wire is of a generally rectangular, frame-like configuration and positioned at that side of the mounting bolt away from the rest arm. The side support terminates in a downwardly-projecting, laterally-displaceable spine or strut having a free end directed toward a base of the loop, the spine being ensleeved in a low-friction, high-lubricity tube. In the arrangement described, the arrow shaft rests on the upwardly angled arm of the wire assembly while simultaneously abutting the side supporting vertical spine of the wire, both the arm and the side support being resiliently displaceable in response to forces applied thereagainst during release of the arrow from the bow.

7 Claims, 1 Drawing Sheet

COMBINATION ARROW REST AND ARROW SHAFT GUIDE

BACKGROUND OF THE INVENTION

The present invention relates to a device for attachment to an archery bow. More particularly, the invention is directed to a simple yet highly effective, unitary combination arrow rest and arrow shaft guide which supports and guides the shaft of an arrow during its propulsion from the bow.

Arrow rests and related devices of the prior art have taken many and varied physical forms and configurations. The devices themselves have been fabricated of many different types of materials including plastics, spring bands, natural and artificial feathers and feather-like materials, leather, as well as natural and synthetic fabrics and bristles. The devices have been ordinarily secured in the window zone of the bow handle and have served as a support for the arrow shaft to enhance the accuracy with which the latter is shot from the bow. Among devices utilized as means for absorbing side thrust or laterial thrust of the arrow shaft as it is propelled from the bow string are collapsible plungers which may be adjusted for laterial positioning with respect to the sidewall of the bow itself. In other arrangements a substantially flat or planar panel may be affixed to the side of the bow handle or lateral abutment of the arrow shaft thereagainst. The arrow rest itself has been the subject of extensive research and developmental work and has, accordingly, developed into a series of various and diverse preferred configurations, each having its own "following" in the archery art. A simple yet highly effective combination arrow rest and side support is described in Saunders U.S. Pat. No. 4,380,226 and the entire disclosure of that reference is hereby specifically incorporated herein by reference to the extent it is not inconsistent herewith. For the most part, the prior art devices have been unduly complex and have failed to provide that degree of satisfaction which one might be inclined to expect of the apparatus involved. Still other devices have actually proven quite ineffective for their intended uses, having the effect of exaggerating the deflection and of impairing overall accuracy. Many of the arrow rests and supports that have been introduced into the field fail adequately to provide the necessary protection and shielding for the arrow vane or fluting, with the result that further deviation from true and accurate flight occurs. In general, the increase in complexity of some of the devices is totally unrelated to and has not resulted in improved accuracy.

It is, therefore, a principal aim of the present invention to provide a relatively simple yet most effective combination arrow rest and lateral support assembly which effectively obviates many of the above-described objectional characteristics, features, and disadvantages of prior art devices and which has found widespread acceptance both for target use and for hunting.

SUMMARY OF THE INVENTION

The present invention constitutes a combination arrow rest and side support assembly fabricated of a pre-shaped high-tensile-strength, flexible and resilient unitary spring wire. The assembly includes an arrow rest section on which an under surface of the arrow shaft rides, and an arrow support section against which a "side" of the arrow shaft abuts as the arrow is released from the bow. The composite, unitary spring wire is fastened at a mid-zone thereof to a threaded bolt which is secured, in turn, to a sidewall of the bow itself.

The arrow rest section of the wire assembly is bent reversely upon itself to form an upwardly open loop, and then outwardly at an upwardly directed angle to terminate in a flexible and resilient rest arm along which the bow shaft glides. In a preferred embodiment of the invention the rest arm is coated with a lubric, low friction material such as a poly halogenated hydrocarbon plastic.

It is an important feature of the composite device of the invention that the loop in the arrow rest section serves as a passageway for unobstructive travel of a vane of the arrow therethrough during flight of the arrow from the bow. The side support section of the unitary wire assembly is of a generally rectangular, frame-like configuration with the "frame" positioned at that side of the mounting bolt away from the rest arm.

In a preferred embodiment of the invention, the side support terminates in a downwardly-projecting, laterally-displaceable spine or strut having a free end generally within lateral bounds of the loop portion of the assembly and directed toward a base of the loop. Preferably, the spine is ensleeved in a low-friction tube which may be of a polyamide plastic, a polyester, silicone, or of a poly halogenated plastics material.

It is an important feature of the improved combination arrow rest and support of the invention that the arrow engaging elements are resiliently mounted and are responsive to pressure forces applied thereto to undergo displacement so as to provide only minimal interference with the true trajectory of the arrow.

In the arrangement described and in the preferred structural embodiment of the invention depicted in the drawings and more fully referred to herebelow, the arrow shaft rests on the upwardly angled arm of the arrow rest while simultaneously abutting the side-engaging vertical spine of the wire assembly. As indicated above, both the arm and the side support are resiliently displaceable in response to forces applied thereagainst during release of the arrow from the bow, so that there is minimum impairment in or disruption of the desired flight trajectory of the arrow shaft.

A related feature of the unitary assembly of the invention is that as the arrow shaft is propelled forwardly with the bow string, the arrow shaft support arm is constrained to move forwardly and, at the same time, the arrow support spine moves forwardly and laterally, away from the arrow shaft support arm. At the same time, a downwardly directed fluting component of the arrow passes, unimpaired and unimpeded, through the loop located below the arrow shaft support arm.

It is an important feature of the present invention that overall frictional forces between the arrow shaft and the arrow rest and support assembly are maintained at a minimum value, contact with these elements being only sufficient to provide the required and desired support for the shaft as the latter is released during initiation of flight.

Other and further objects, features, and advantages of the invention will become apparent from the reading of the following specification considered in conjunction with the drawing.

DETAILED DESCRIPTION OF THE ILLUSTRATED EMBODIMENT

Figure 1:
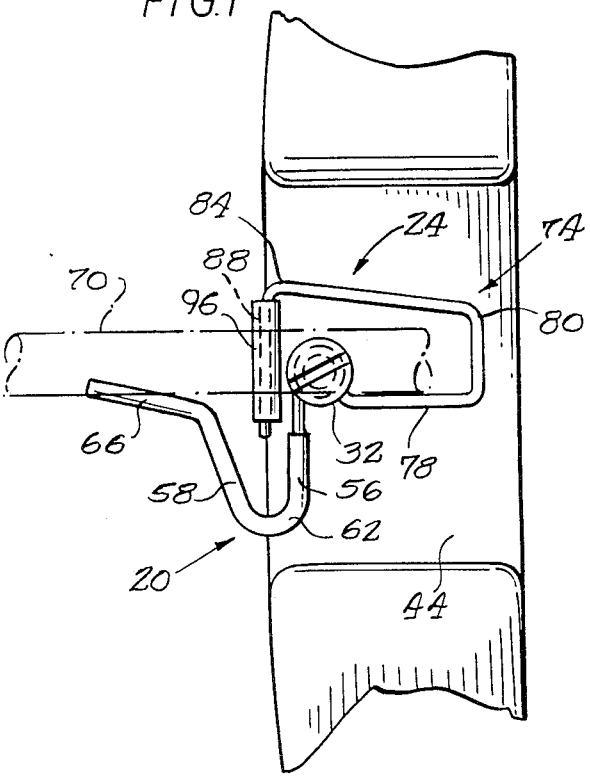
FIG. 1 is a fragmentary, schematic, side elevational view of a bow structure with an arrow rest and guide assembly embodying the features of the invention, the assembly being mounted in the window of a bow.

The aims and objects of the invention are achieved by providing an assembly constituting, in combination, an arrow rest and an arrow shaft support or guide formed of a unitary, flexible and bendable, high-tensile-strength, resilient spring wire. The wire assembly is fastened at a mid-zone, bight portion thereof to a bolt which is, in turn, threadedly secured to the bow at its window zone. Opposite, projecting free ends of the wire define an outwardly projecting arrow rest arm and a downwardly directed arrow shaft abutment support or spine-like spur or guide. The arrow shaft engaging portions of the wire are preferably coated or sleeved within an enveloping, low-friction, high-lubricity plastics material to minimize frictional drag forces on the arrow shaft, and the wire is looped to provide a channel for accommodating free passage of the vane or fletching of an arrow released from the bow.

Referring now more particularly to the drawing (FIGS. 1 and 2), for purposes of disclosure and not in any limiting sense, one preferred embodiment of the combination arrow rest and arrow shaft guide 20 of the invention is shown as comprising a high-tensile-strength, resilient, spring wire 24 curved upon itself at a mid-zone thereof to define a restricted or bight portion 26. A screw 30 having an enlarged head 32 and a threaded shank 34 abuts and bears upon the wire 24 at the arcuate bight 26 and threadedly engages making internal threads 34 in a bore 36 or a shaft 42. The later is threadedly 38 secured in the handle 44 of the bow so that the wire 24 is mounted in an arrow shaft supporting and guiding mode at the face of the bow window 46, as shown in FIGS. 1 and 2.

Figure 2:
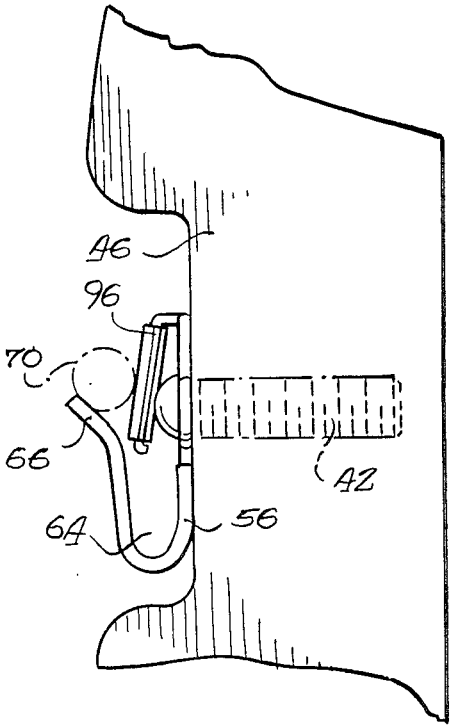
FIG. 2 is a fragmentary, front view of the combination arrow rest and arrow shaft guide as seen from the side of the bow away from the bow string.
Figure 3:
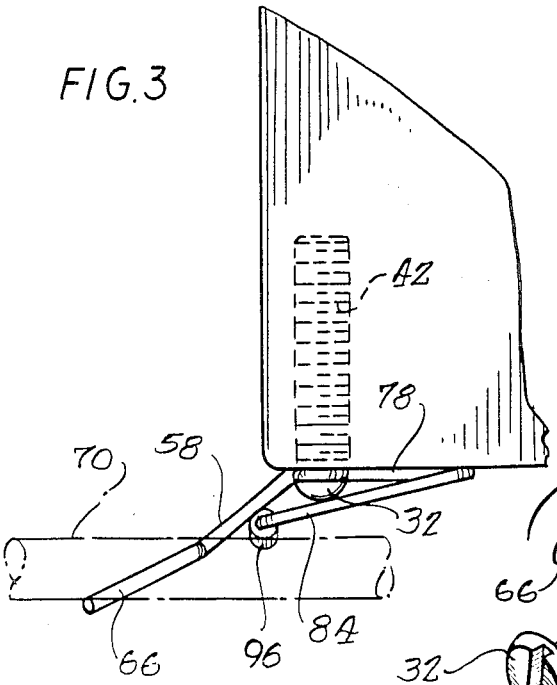
FIG. 3 is a top plan view of the arrow rest and guide assembly of FIG. 1.
Figure 4:
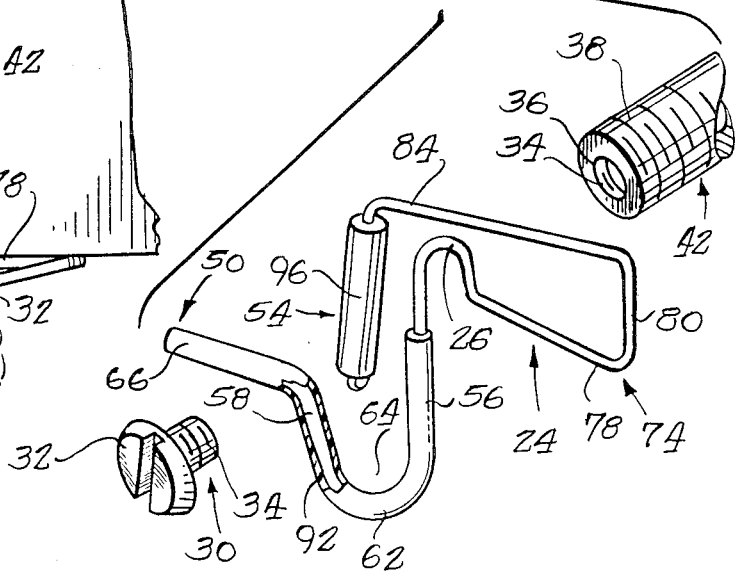
FIG. 4 is a fragmentary, exploded view, partly in section, and showing the arrow rest and guide assembly and the bow attachment bolt.

As clearly illustrated in FIGS. 1 and 4, the wire 24 is divided at the bight portion 26 into two separate and distinct, yet cooperating segments—an arrow rest section 50 and an arrow shaft side support or lateral guide section 54. The arrow rest section 50 includes a pair of spaced legs 56 and 58 connected by an upwardly open loop 62. The structure described demarks a channel or passageway 64 for accommodating an arrow shaft vane or fletching traveling through the channel 64 upon release of an arrow from the bow.

The arrow rest section 50 terminates at its free end in a laterally-directed, freely-extending, upwardly angled arm 66 for contacting and for resiliently supporting the arrow shaft 70 during release of the arrow from the bow.

The side support or arrow shaft guide section 54 of the wire 24 defines a generally rectangular frame 74 extending laterally of and away from the rest arm 66 and at an elevation above a lower limit of the loop 62, as shown in FIGS. 1 and 4.

The frame 74 includes a generally horizontally disposed base sector 78, an upwardly directed, substantially vertically extending end 80, and a reversely-directed, slightly upwardly pitch, and somewhat forwardly angled, transverse upper component 84, as shown in FIG. 1. The frame 74 is completed by a spur, strut, or spine 88 which projects downwardly of and essentially normal with respect to the surmounting wire component 84 so that the free end 90 of the strut 88 projects between the frame legs 56 and 58 and is directed toward the channel 64.

It will be understood that in the structural configuration of the assembly 24 described, that upon drawing the bow string and with the arrow held at ready, the shaft 70 of the arrow rests upon the rest arm 66 and, simultaneously, abuts the vertical strut 88 (FIG. 2). Upon release of the arrow, the shaft 70 rides upon the rest arm 66 and frictional forces developed effect a limited displacement of the rest arm 66. At the same time, the shaft 70 of the arrow bears against and urges the strut 88 toward the window of the bow, the strut serving as a guide ensuring an enhanced degree of reliability and minimizing objectionable interference with a true flight trajectory of the arrow. Minimization of disruptive influences on the arrow flight is further promoted by the provision of the channel 64 permitting passage of the fletching of the arrow upon its release of the bow. The resiliently supported rest arm 66, and the resilient guide strut 88 cooperate, in conjunction with the channel 64 of the arrow rest of the guide assembly 20, to effectuate the aims and objects of the present invention.

In preferred embodiments of the ivention frictional interference between the shaft 70 of the arrow and the contacting elements of the combination arrow rest and arrow shaft guide is further reduced by providing a low-friction coating 92 of a high-lubricity composition on the arrow shaft support arm 66, and an enveloping sleeve 96 or tube of a low friction, high-lubricity material in a rotatably supportive mode on the arrow shaft contacting strut 88.

What is claimed is:

1. An arrow support and guide assembly for use in an archery bow having a rigid mid-section including a sidewall defining a shelf and a window within which said assembly may be mounted, said assembly comprising a unitary, flexible and bendable, high-tensile-strength spring wire defining, in combination, an arrow rest section and a side support section for resiliently supporting and guiding an arrow shaft shot from a bow, and bolt means for adjustably and lockingly supporting said assembly on said bow at the sidewall thereof, fastening means attaching said wire in a mid-zone thereof to said bolt means, said arrow rest section of said wire extending downwardly of said bolt means at a mid-zone of said wire, and being bent reversely to form a loop of an upwardly open U-shaped configuration and bounded by opposed, spaced legs, said legs delineating therebetween a passageway providing a channel for accommodating an arrow shaft fletching traveling therethrough during release of an arrow from the bow, said arrow rest section of said wire terminating in a laterally-directed, freely-extending, upwardly-angled arm for contacting and for resiliently supporting the arrow shaft thereon during the release of the arrow from the bow, said side support section of said wire having a generally rectangular, frame-like configuration and extending laterally of and away from said arm and at an elevation upwardly of a lower limit of said loop, said side support section terminating in a downwardly extending spine having a free lower end disposed between said legs of said loop and projecting toward said lower limit thereof, said spine being resiliently displaceable laterally upon application of arrow-shaft-generated flight forces applied thereagainst, and said spine constituting abutment means for stressingly and resiliently engaging and supporting, at an outside surface thereof, the shaft of an arrow forcibly projected from the bow.

2. The structure as set forth in claim 1 wherein said legs of said loop lie in a plane angled forwardly and outwardly with respect to said bolt means.

3. The structure as set forth in claim 1 wherein said wire is formed at said mid-zone thereof with a bight portion, and wherein said bolt means is formed with a threaded bore extending axially therewithin from an end of said bolt means adjacent said mid-zone of said wire, and further comprising a wire-anchoring screw, said screw having head means overlying and bearing upon said wire at said bight portion thereof and having a threaded shank matingly engaged within said threaded bolt means for securing said wire to said bolt means.

4. The structure as set forth in claim 1 and further comprising a low friction coating enveloping said arm of said arrow rest section.

5. The structure as set forth in claim 1 and further comprising a low friction tube enveloping said spine of said side support section of said wire as a sleeve thereabout.

6. The structure as set forth in claim 5 wherein said tube is coaxial with said spine and freely rotatable thereon.

7. The structure as set forth in claim 1 wherein said downwardly extending spine of said side support section of said wire is angled forwardly.

* * * * *